US011459700B2

(12) United States Patent
Ketolainen et al.

(10) Patent No.: US 11,459,700 B2
(45) Date of Patent: Oct. 4, 2022

(54) METHOD OF AND AN ARRANGEMENT FOR ADDING AT LEAST ONE ADDITIONAL STOCK COMPONENT TO AN APPROACH FLOW SYSTEM OF A FIBER WEB MACHINE

(71) Applicants: Wetend Technologies Oy, Savonlinna (FI); Valmet Technologies Oy, Espoo (FI)

(72) Inventors: Antti Ketolainen, Jyväskylä (FI); Jouni Matula, Savonlinna (FI); Leif Piippola, Tampere (FI)

(73) Assignees: WETEND TECHNOLOGIES OY, Savonlinna (FI); VALMET TECHNOLOGIES OY, Espoo (FI)

( * ) Notice: Subject to any disclaimer, the term of this patent is extended or adjusted under 35 U.S.C. 154(b) by 0 days.

(21) Appl. No.: 17/127,548

(22) Filed: Dec. 18, 2020

(65) Prior Publication Data

US 2021/0189650 A1 Jun. 24, 2021

(30) Foreign Application Priority Data

Dec. 20, 2019 (EP) ..... 19218416

(51) Int. Cl.
*D21F 1/02* (2006.01)

(52) U.S. Cl.
CPC ..... *D21F 1/026* (2013.01); *D21F 1/022* (2013.01); *D21F 1/024* (2013.01)

(58) Field of Classification Search
CPC . D21F 1/00; D21F 1/026; D21F 1/022; D21F 1/024; D21F 1/0018; D21F 1/08; D21F 1/82; D21F 1/06; D21H 23/20
See application file for complete search history.

(56) References Cited

U.S. PATENT DOCUMENTS 6,659,636 B1 12/2003 Matula
2002/0121350 A1* 9/2002 Lamminen ..... B01F 5/0475 162/100
2002/0131325 A1* 9/2002 Matula ..... B01F 5/0057 366/165.1
2008/0230194 A1* 9/2008 Matula ..... B01F 5/045 162/166

FOREIGN PATENT DOCUMENTS

EP 1219344 7/2002

OTHER PUBLICATIONS

Extended European Search Report for EP Application No. 19218416.6 dated Jun. 18, 2020, 8 pages.

* cited by examiner

*Primary Examiner* — Eric Hug
*Assistant Examiner* — Matthew M Eslami
(74) *Attorney, Agent, or Firm* — Nixon & Vanderhye P.C.

(57) ABSTRACT

A method of and an arrangement for adding at least one additional stock component to an approach flow system (30) of a fiber web machine by mixing the at least one additional stock component to a fibrous stock such that the stock flow is equalized (50) and the at least one additional stock component is introduced to the stock flow by injection mixing (80).

15 Claims, 3 Drawing Sheets

METHOD OF AND AN ARRANGEMENT FOR ADDING AT LEAST ONE ADDITIONAL STOCK COMPONENT TO AN APPROACH FLOW SYSTEM OF A FIBER WEB MACHINE

RELATED APPLICATION

This application claims priority to European patent application 19218416.6, filed Dec. 20, 2019, the entirety of which is incorporated by reference.

TECHNICAL FIELD

The present invention relates to a method of and an arrangement for adding at least one additional stock component to an approach flow system of a fiber web machine headbox. More specifically the present invention concerns mixing of at least one additional stock component to a fibrous stock flowing in the approach flow system of a fiber web machine headbox.

BACKGROUND

A paper machine or, in broader terms, a fiber web machine is preceded by an approach flow system in which the fibrous suspension, called stock, used for making a fibrous web at the fiber web machine is prepared. At the approach flow system various stock components, i.e. virgin and/or recycled pulp and/or broke are mixed together with white water recovered from the fiber web machine, fillers and other desired additives are mixed with the stock and the stock or one or more of its components are, if considered necessary, deaerated. Further, at the approach flow system the stock is introduced by means of a headbox feed pump, normally a specifically designed centrifugal pump, to a headbox screen where the stock is finalized for the web production at a headbox. The approach flow system is also provided with a mixer or mixers for adding retention chemical(s), as well as possibly other chemicals or additives, to the stock. Depending on the type of the chemical, such may be added to the stock as early as in the mixing chest or as late as just upstream of the headbox, i.e. between the headbox or machine screen and the headbox.

Wet end chemicals have been used for a long time in paper making for example for retaining fine solids like for instance fillers and other additives used in the production of paper, in the fibrous web while water, so called white water, is drained from the fibrous web at the forming and drying sections of the fiber web machine. The wet end chemicals such as retention chemicals bind the solids to one another and to fibers of the stock soon after they are introduced into the mixture of fibers and the solids. The introduction of wet end or retention chemical(s) may take place before or after the headbox screen. However, usually the introduction is performed in such a stage that the agglomerations formed by the wet end or retention chemical(s) are formed only after the headbox screen, as, on the one hand, the screen could easily sort out such agglomerations from the stock the web is later on made, or, on the other hand, the screen by creating turbulence could break the agglomerations and thereby reduce the retention of solids in the web. Therefore, quite often the wet end or retention chemical(s) are added to the outlet duct of the headbox screen where there is such weak turbulence left that is not capable of breaking the agglomerations to be formed but is still capable of aiding in the mixing of the wet end or retention chemical(s).

As long as paper has been made with paper machines the strive has been towards higher quality end products. A factor having an essential role in paper quality is the use of various chemicals and/or additives. However, for a number of reasons there is a constant aim to reduce the use of chemicals and additives. Firstly, the chemicals are more costly than cellulose fibers, whereby the cost-aspects push towards reduction in the chemical usage. Secondly, naturally, when chemicals are mixed with paper making stock a part of the chemicals end up into circulation waters, and irrespective of the efficiency of water-recirculation a small part of the chemicals always enter the waste water treatment and possibly into lakes, rivers or sea. Thereby, both for economical and environmental reasons the use of chemicals and additives should be made as efficient as possible. In other words, a minimal amount of chemicals should be used and the chemical should be mixed as evenly as possible with the stock flow.

A starting point for the present invention is a chemical mixer of Valmet Corporation, called OptiMixer™ and discussed in US Patent Application Publication 2002/0121350 (350 application). The 350 application discloses a static mixer, which comprises a mixer flow pipe that has a diameter equal with that of the stock flow pipe taking the paper making stock towards the paper machine headbox. The mixer flow pipe is fastened to the stock flow pipe by means of flanges and the inner circumference of the mixer flow pipe is provided with a number of circumferentially arranged form parts. The purpose of the form parts is to generate turbulence for mixing chemicals to the stock. The 350 application teaches several ways of adding the chemical to the stock. In a first embodiment the chemical is introduced via the form parts to the stock, in a second embodiment the chemical is introduced to the stock immediately upstream of the form parts, in a third embodiment the chemical is introduced immediately after the form parts. And, in a fourth embodiment the chemical is introduced, in circumferential direction, between the form parts to the stock.

In all the above discussed embodiments the principle of mixing the chemical is the same. However, in recently performed experiments it has been learned that the use of chemicals may be made more effective if a few facts are taken into account. Firstly, the stock flow coming from the headbox screen or the machine screen or any other device along a stock flow pipe to the static mixer has an irregular consistency profile, like in any flow pipe. In other words, the parts of the stock flowing nearest to the flow pipe surface have the lowest consistency, and the parts flowing at the center of the flow pipe have the highest consistency. Secondly, now that a chemical is introduced to the stock either directly through the wall of the mixer flow pipe or via the form parts, the chemical gets into contact with such parts of the stock that have the lowest consistency. The 350 application also discusses embodiments, where the chemical is introduced to the stock flow at a distance from the wall whereby the stock consistency is somewhat higher than that at the pipe surface, but still not the same as in the middle of the flow. And the embodiment has such a clear downside that the nozzle extending from the pipe wall inside the pipe gathers impurities that make the feed of the chemical more difficult and deteriorates the quality of the end product.

What the above consistency-related problems mean in practice is that the concentration of the active chemical (not yet reacted or fastened to solid matter) is at its highest there where the solids consistency of the stock is at its lowest. Accordingly, the chemical performs its action efficiently with the solids in the low consistency stock, and, as a result, the concentration of the chemical decreases and less chemical is left for the solids in the higher consistency stock. Thereby the solids in the higher consistency stock have less chemical to react with or to be fastened to. Thereby the final result of such mixing is uneven treatment of the solids with chemicals, and in order to make sure that in all parts of the stock there is sufficient amount of chemical, the chemical dosage has to be increased beyond optimal. Additionally, there is a risk that, for instance, the filler retention is not even throughout the stock whereby the cross-machine profile of the filler in the end product is not even, and the quality of the end product is not as good as it could optimally be.

SUMMARY

The present invention may be embodied to solve one or more one of the above discussed problems.

The present invention may be embodied to use optimal amount of chemical(s) and/or additives and thereby reduce the chemical/additive costs involved in the production of a web-like article.

The present invention may be embodied to reduce the amount of chemicals/additives loading the waste water treatment of the paper mill.

The present invention may be embodied to improve the construction of the headbox feed pipe such that minimal amount of consistency differences end up in the headbox.

The present invention may be embodied to improve the construction of the headbox feed pipe such that the positions of various devices provided in connection with the headbox feed pipe are carefully determined.

The invention may be embodied to provide chemical/additive dosing method for new functional fiber based products having more demanding requirements for chemical/additive dosing than conventional paper and board making.

The present invention may be embodied as arranging in a headbox feed pipe, a stock flow equalizer that mixes the stock flow efficiently upstream of the chemical introduction such that any consistency differences are minimized or totally removed. The stock flow equalizer forms a strong turbulent zone of chaos-like turbulence that continues up to chemical introduction. The chemical(s) is/are introduced to the equalized, but still turbulent, stock flow by means of an injection mixing station that is known to be able to spread chemical(s) evenly to the entire cross-section of a stock flow pipe. A good example of such an injection-type chemical mixer or injection mixing station, is TrumpJet™ mixer of Wetend Technologies Ltd that has gained wide acceptance in the field of mixing retention and other chemicals to fibrous suspensions. The above mentioned TrumpJet™ mixer and its use are discussed in, for instance, European Patent B1-1219344. The TrumpJet™ mixer is used as a mixing station formed either of a single injection mixing unit or of a number of injection mixers or injection mixing units arranged on the circumference of the stock flow pipe in which the medium to which the chemical is supposed to be mixed flows.

The present invention may include adding at least one additional stock component to a stock flow in an approach flow system of a fiber web machine headbox, wherein a fibrous stock is introduced by means of a headbox feed pump via a headbox screen, a headbox feed pipe and a chemical mixer to the headbox of a fiber web machine, in which method the stock flow is treated by equalizing consistency differences prevailing in the stock flow downstream of the headbox screen and mixing the at least one additional stock component with the stock.

The present invention may include an arrangement for adding at least one additional stock component to a stock flow in an approach flow system of a fiber web machine headbox, the approach flow system comprising a headbox feed pump, a headbox screen a chemical mixer and a headbox feed pipe; a stock flow equalizer is arranged in the headbox feed pipe at a distance from the chemical mixer arranged between the headbox screen and the headbox.

BRIEF DESCRIPTION OF DRAWINGS

In the following the prior art and the present invention are discussed in more detail with reference to the accompanying drawings, in which.

DETAILED DESCRIPTION

Figure 1:
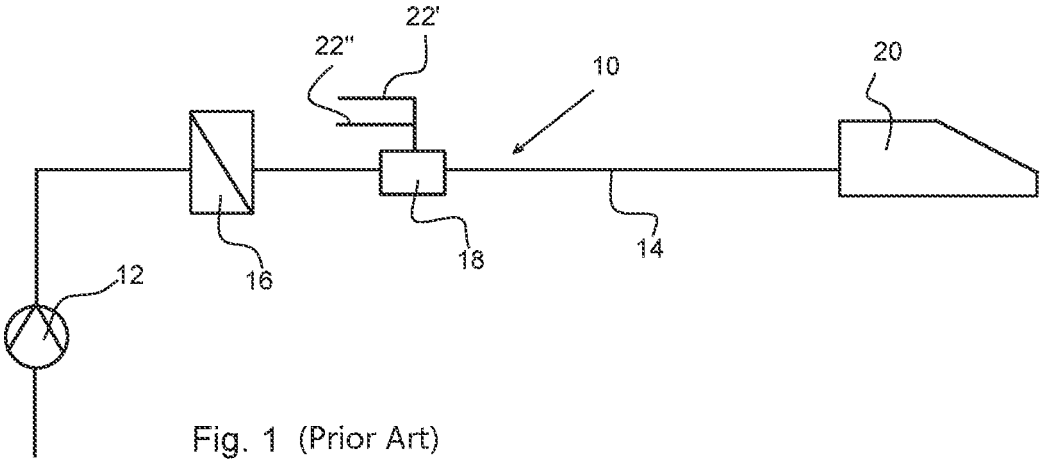
Fig. 1 (Prior Art)
FIG. 1 illustrates a partial view of a prior art approach flow system of a fiber web machine.

FIG. 1 illustrates a partial view of a prior art approach flow system of a fiber web machine. In accordance with the Figure the approach flow system 10 of the fiber web machine comprises, in addition to the not-shown components, a headbox feed pump 12, a stock flow pipe 14, a headbox screen 16, a chemical mixer 18 and a headbox 20 via which the fibrous stock is delivered to the forming section of the fiber web machine, normally on the wire or forming section thereof. The chemical mixer 18 is an OptiMixer™ of Valmet Corporation discussed in more detail in US Patent Application Publication 2002/0121350. The chemical mixer 18 has a number of feed openings arranged on the circumference of the mixer, the feed openings being arranged into cooperation with the form parts of the mixer. Each feed opening may have only one feed channel for the chemical, or two feed channels 22' and 22", as shown in the Figure. In accordance with the US-document feed channel 22' may be used for feeding filling agent or fiber pulp, and feed channel 22" for feeding some other chemical such that the two components are mixed with each other before introduction via the feed opening to the stock in the stock flow pipe 14.

As discussed already above, feeding one or more chemicals to the stock flow that has not yet been completely mixed so that the consistency variations in the stock flow would have been equalized brings about problems that may be seen in both the quality of the end product and in the unnecessarily high dosage of chemicals, resulting in increased chemical costs.

Figure 2A:
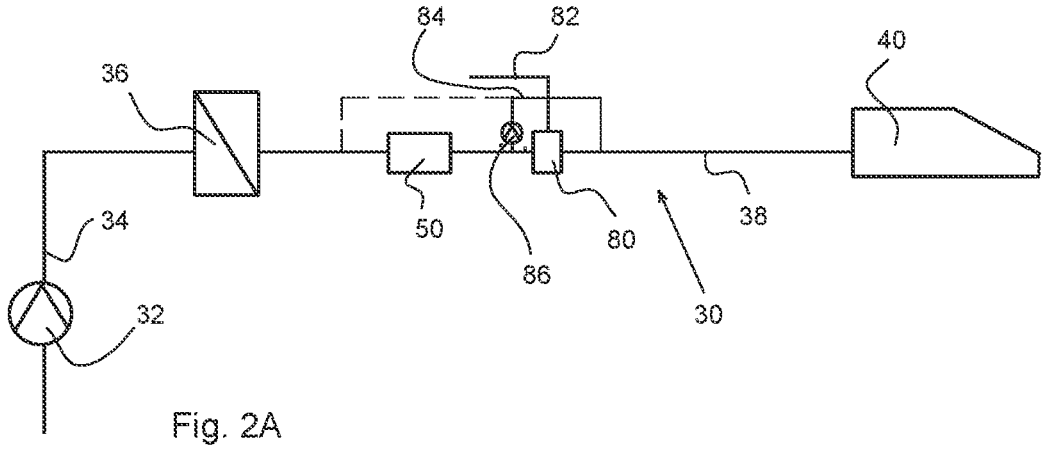
FIG. 2A illustrates a partial view of a novel approach flow system of a fiber web machine in accordance with an embodiment of the present invention.

FIG. 2A illustrates a partial view of an approach flow system of a fiber web machine in accordance with the present invention. The novel approach flow system 30 of the fiber web machine comprises, in addition to the not-shown components, a headbox feed pump 32, a stock flow pipe 34, a headbox screen 36, a headbox feed pipe 38 and a headbox 40 via which the fibrous stock is delivered to the forming section of the fiber web machine, normally on the wire or forming section thereof. The headbox feed pipe 38 extending from the headbox screen 36 or machine screen to the headbox 40 is provided with a stock flow equalizer 50 (discussed in more detail in FIGS. 3 and 4*a*-4*b*) and an injection mixing station 80. As shown in the FIG. 2A the injection mixing station 80 has at least one inlet channel or a set of inlet channels 82 for one or more chemicals to be introduced to the stock flow in the headbox feed pipe 38. The injection mixing station 80 has also at least one inlet channel 84 for receiving injection liquid. The injection liquid may be withdrawn from the headbox feed pipe 38 and pumped by means of a pump 86 to the injection mixing station 80. In accordance with an embodiment of the present invention, the injection liquid is taken from the headbox feed pipe 38 between the stock flow equalizer 50 and the injection mixing station 80 from such a position that the consistency variations in the stock flow have already been equalized. In accordance with another embodiment (shown by broken lines) the injection liquid is taken from the headbox feed pipe upstream of the stock flow equalizer 50. And in accordance with a yet further embodiment the injection liquid is taken from the headbox feed pipe downstream of the injection mixing station 80. The injection mixing station is preferably, but not necessarily, formed of one or more TrumpJet™ injection mixers. The TrumpJet™ injection mixer and its use are discussed in, for instance, European Patent B-1219344.

Figure 2B:
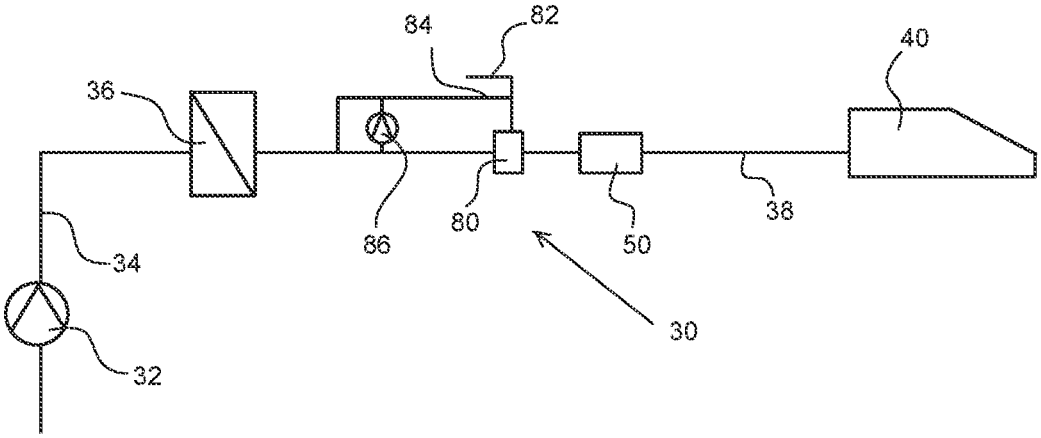
FIG. 2B illustrates a partial view of a novel approach flow system of a fiber web machine in accordance with another embodiment of the present invention

FIG. 2B illustrates a partial view of an approach flow system of a fiber web machine in accordance with the present invention. The parts as similar to FIG. 2A but the FIG. 2B presents the other option to perform the method for mixing the at least one additional stock component with the stock before and/or after equalizing consistency differences prevailing in the stock flow downstream of the headbox screen. The arrangement as shown in FIG. 2B presents that the chemical mixer 80 is arranged upstream of the stock flow equalizer 50. For certain type of additional stock components (as fibrous components may be) this is the preferred option while the embodiment of FIG. 2A is the preferred one for some additional stock components. A combination of embodiments of FIGS. 2A and 2B is also possible (not shown in Figures), then the chemical mixer 80 is arranged upstream and downstream of the stock flow equalizer 50. Then at least one but likely a number of additional stock component(s) is mixed with the stock before and after equalizing consistency differences prevailing in the stock flow downstream of the headbox screen 36. This arrangement may be preferred for example for mixing cationic and anionic additional stock components in selected order. It is also possible to double or triple one of chemical mixers if even more additional stock components are needed to be mixed.

Figure 3:
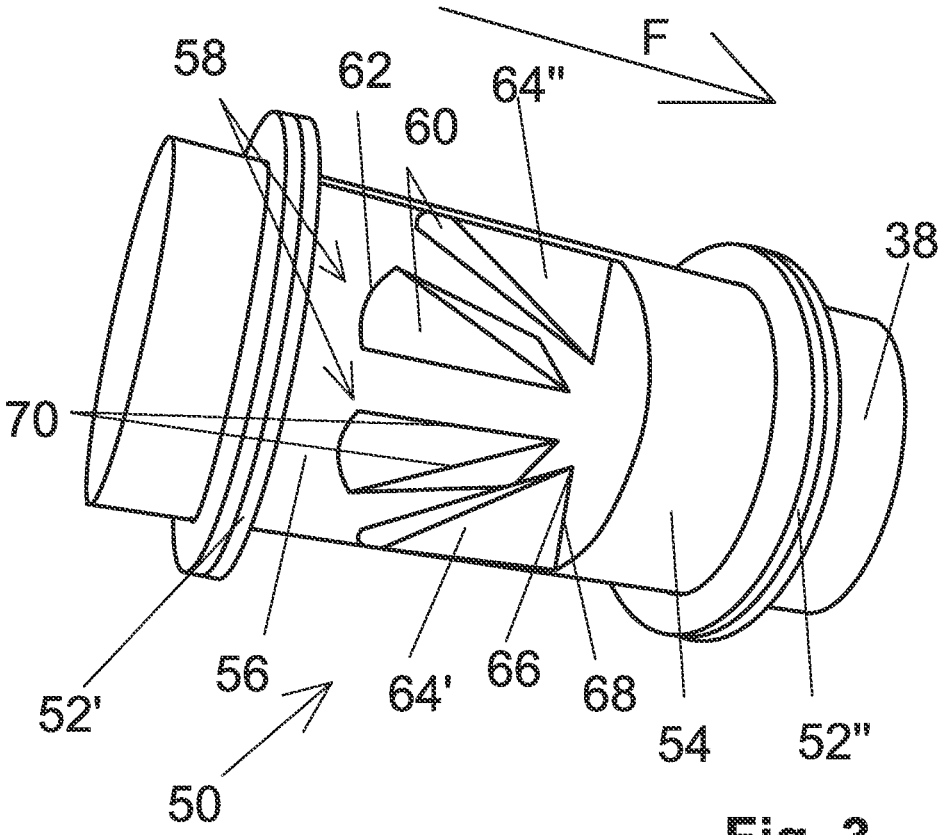
FIG. 3 illustrates a partially cut view of a stock flow equalization mixer or stock flow equalizer in accordance with an embodiment of the present invention.
Figure 4A:
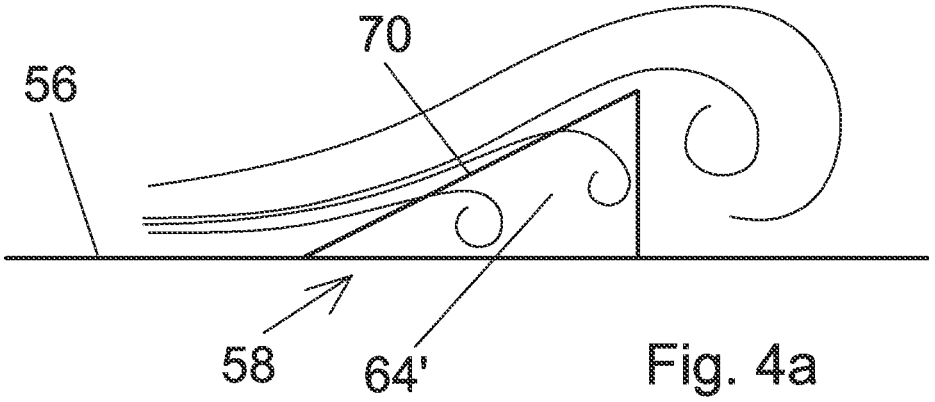
FIG. 4*a* illustrates the operation of the form parts of the stock flow equalizer as seen from the side of the form part.
Figure 4B:
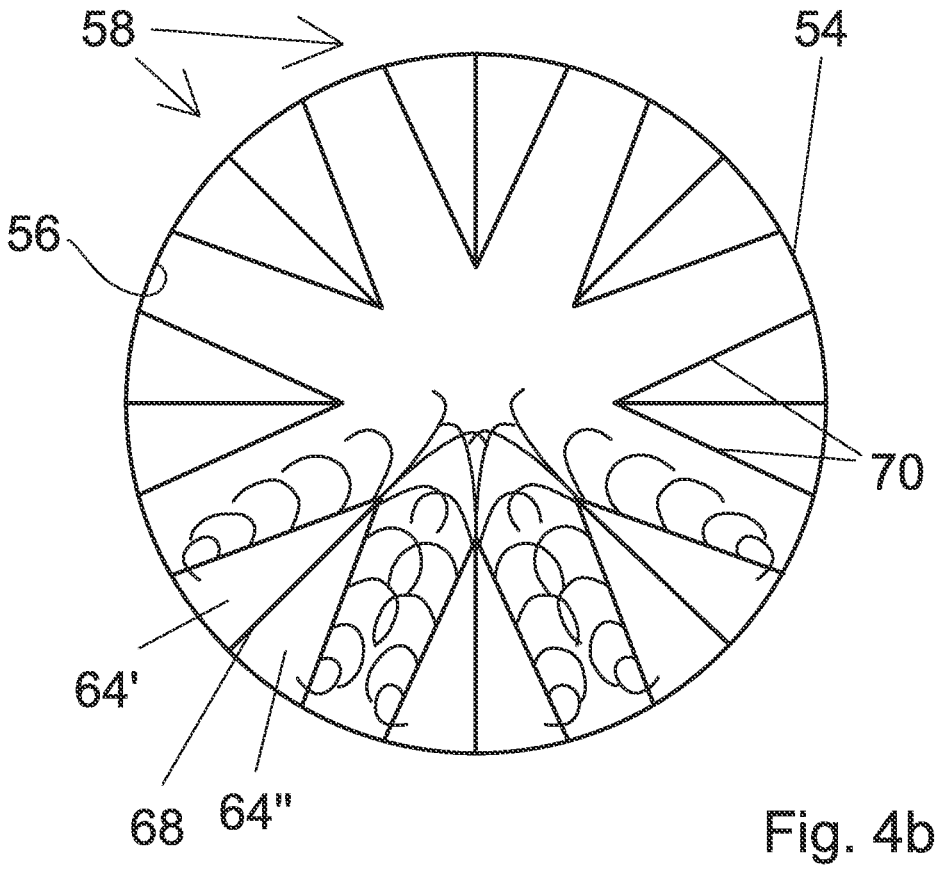
FIG. 4*b* illustrates the operation of the form parts of the stock flow equalizer as seen from the direction of the headbox.

FIG. 3 illustrates a partial cut view of the stock flow equalizer 50 of the present invention. In the embodiment shown in the Figure the stock flow equalizer 50 is fastened by means of flanges 52' and 52" to the headbox feed pipe 38. The stock flow equalizer 50 has a tubular wall 54 the diameter of which corresponds to that of the headbox feed pipe 38. The inside surface 56 of the tubular wall 54 is provided with form parts 58, which are, in this embodiment, arranged on the same periphery of the inside surface 56. In another embodiment the form parts are attached directly to the inside surface of the headbox feed pipe so that no additional pipeline flanges are needed, but only the headbox feed pipe is fastened at its first end to the machine screen and at its second end to the headbox. Each form part 58 has a leading surface 60 that is fastened to the inside surface 56 of the tubular wall 54 along its leading edge 62. Arrow F indicates the stock flow direction through the stock flow equalizer 50. Downstream of the leading edge 62 the leading surface 60 is raised from the inside surface 56 such that triangular side surfaces 64' and 64" may be provided between the side edges of the leading surface 60 and the inside surface 56. The leading surface 60 tapers towards its trailing tip 66 such that the side surfaces 64' and 64" may be fastened to one another at the trailing edge 68 of the form part 58.

The form parts 58 function (see FIGS. 3, 4*a* and 4*b*) such that their leading surfaces 60 raise the stock flow, which is at a lower consistency, from the near-hood of the inside surface 56 closer to the center of the tubular flow pipe to mix the low consistency stock with the higher consistency stock closer to the axis of the flow pipe. At the same time a part of the stock flowing along the leading surfaces 60 meets the side edges 70 between each leading surface 60 and the side surfaces 64' and 64", whereby such parts of the stock flow create two counter-rotating vortices at both sides of each form part 58. First the vortices get mixed with the low consistency stock flow that still flows along the inner surface 56 passing the form parts. Later, when the vortices of two neighboring form parts meet one another, the vortices get mixed to one another and create a chaos-like turbulent zone extending downstream of the form parts. Such a turbulent zone extends over the entire diameter of the stock flow equalizer and equalizes the consistency differences there have been. In performed experiments it has been learned that the full equalization of the stock flow requires a distance of at least 1×D, such as 3×D, where D is the diameter of the headbox feed pipe, As to the stock flow equalizer 50 it should be understood that the number of form parts 58 thereof may vary from 3-15, the form parts may be arranged on the same circumference of the inside surface 56 of the stock flow equalizer 50, or they may be divided in several groups on several circumferences, or they may be freely arranged in arbitrary positions on the inside surface. Naturally, their axial distance from one another should not be too long, which would reduce the efficiency of the stock flow equalization function. A length of the stock flow equalizer, i.e. from the leading edge of the upstream form part to the trailing tip of the downstream form part may be in a range of 0.5 to 3×D, where D is the diameter of the headbox feed pipe. The radial height of the form parts 58 is may be in a range of 0.1 to 0.5×D, where D is the diameter of the headbox feed pipe. A width of the form part may be in a range of 0.1 to 1×length of the form part. Also the leading surface 60 of the form part is not necessarily planar, but it may be curved, i.e. convex or concave, in either radial or axial cross sections thereof, or in both.

As already discussed above in connection with FIG. 2A the stock flow optimizer 50 is followed on the headbox feed pipe 38 by an injection mixing station 80. The distance between the stock flow equalizer and the injection mixing station should be arranged such that the chaos-like turbulence has already equalized the consistency but has not dampened to such a degree that the consistency differences had already started forming. In practice the distance from the trailing tip of the last (in the stock flow direction) form part to the injection mixing station may be in a range of 0.5 to 10 times, such as 2 to 5 times, the diameter D of the headbox feed pipe 38. Also, for the optimization of the headbox feed pipe and additional stock component mixing, the stock flow equalizer 50 may be arranged at a distance from the headbox 40. The distance from the injection mixing station 80 to the headbox 20 need to be considered carefully. Naturally, if the stock flow equalizer 50, and the injection mixing station 80 therewith, is brought too close to the headbox, the turbulence caused by the equalizer would have an effect on the stock flows in the headbox, and would make it more difficult to achieve an even basis weight profile to the web to be formed. And if the stock flow equalizer 50, and the injection mixing station therewith, are left too far from the headbox, the stock flow in the headbox feed pipe 38 would have time to start forming consistency differences in the stock flow. Therefore, the distance from the stock flow equalizer 50 to the headbox 20 may be in a range of 5×D to 15×D, where D is the diameter of the headbox feed pipe 38.

The chemical mixer 80 may be an injection mixing station, which may be formed of a single injection mixer or a set of injection mixers. In narrow pipes a single injection mixer may suffice, but with larger pipes an injection mixing station with several injection mixers on the periphery of the headbox feed pipe are needed. In operation, at least one additional stock component and an injection liquid is brought to the injection mixer, each along its own feed channel. The additional stock component and the injection liquid are introduced with one another via a common nozzle to the equalized stock flow such that the additional stock component is mixed with the injection liquid and the injection liquid, due to its high speed and injection pressure, ensures that the mixture of a relatively small amount of the additional stock component and the injection liquid penetrates deep enough in the equalized stock flow in the headbox feed pipe. The injection liquid may be the same stock to which the additional stock component is to be mixed. Such an injection liquid may be taken upstream of the mixer to be injected by means of the mixer together with the additional stock component to the stock flow in the headbox feed pipe. It was already earlier mentioned that the injection liquid may be taken from the headbox feed pipe either upstream of the stock flow equalizer, between the equalizer and the injection mixing station or downstream of the injection mixing station. Other options for the injection liquid are fresh pulp, recycled pulp, white water, fresh water, etc. just to name a few options without any intention of limiting the applicable liquids to the listed alternatives only.

It should also be understood that the present invention covers mixing either a single additional stock component or two or more additional stock components to the stock upstream and/or downstream of the stock flow equalizer. In other words, it is possible that in cases where more than one additional stock component is used (in addition to the one mixed downstream of the stock flow equalizer), one additional stock component is mixed to the stock between the headbox screen and the stock flow equalizer and/or one additional stock component is mixed to the stock upstream of the headbox screen. Naturally, it is preferable in these two latter alternatives that the additional stock component is such a slowly reacting one that it functions or forms agglomerations only after the stock flow equalizer.

And finally, it should also be understood that at least one additional stock component is at least one of retention chemical, sizing agent, like alkenyl succinic anhydride (ASA) or alkyl ketene dimer (AKD), starch, filler, paper dye or pigment, micro- or nano-fibrillated cellulose (MFC, NFC) or other natural/bio-based fiber or synthetic fiber, just to name a few options. These additional stock components may be mixed with the stock either together with another additional stock component(s) or independently thereof. If introduced together with some other additional stock component these may be either premixed with the additional stock component(s) prior to being injected to the stock or just injected together with the additional stock component(s) to the stock.

It should be also understood that the above presented dimensions in different embodiments in relation to the headbox feed pipe diameter D may vary significantly depending on the actual application. In a small size approach flow systems of a fiber web machine headbox, the diameter D may be 50 to 100 mm. In large fiber web machine, the diameter D may be approximately 1200 mm.

Although the invention has been described with reference to specific illustrated embodiments, it is emphasized that it also covers equivalents to the disclosed features, as well as changes and variants obvious to a man skilled in the art, and the scope of the invention is only limited by the appended claims.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention is:

1. A method of adding at least one additional stock component to a stock flow in an approach flow system of a fiber web machine headbox, wherein a fibrous stock is introduced by a headbox feed pump via a headbox screen, a headbox feed pipe and a chemical mixer to the headbox of a fiber web machine, the method comprises:

treating the stock flow by equalizing consistency differences prevailing in the stock flow downstream of the headbox screen to form an equalized but not dampened stock flow, and after treating the stock flow to form the equalized but not dampened stock flow, mixing the at least one additional stock component with the already equalized but not dampened stock flow.

2. The method as recited in claim 1, further comprising providing a stock flow equalizer to perform the step of the treating the stock flow by equalizing the consistency differences prevailing in the stock flow, wherein the stock flow equalizer is between the headbox screen and the chemical mixer at a distance from the chemical mixer.

3. The method as recited in claim 1, further comprising using an injection mixing station to add the at least one additional stock component to the stock flow by using at least one of fresh pulp, recycled pulp, white water and fresh water as an injection liquid for the injection mixing station.

4. The method as recited in claim 1, further comprising using an injection liquid to carry the at least one additional stock component into the equalized stock flow.

5. The method as recited in claim 1, further comprising using an injection mixing station to add the at least one additional stock component to the stock flow, wherein the injection mixing station uses an injection liquid to carry the at least one additional stock component to the stock flow, and the injection liquid is stock from the headbox feed pipe take upstream or downstream of the stock flow equalizer and upstream of the injection mixing station.

6. The method as recited in claim 1, wherein the at least one additional stock component is at least one of: a retention chemical, sizing agent, a starch, filler, paper dye or pigment, a micro-fibrillated cellulose, a nano-fibrillated cellulose, a bio-based fiber and a synthetic fiber.

7. A method comprising:

pumping a flow of stock of a suspension of fibers through a headbox pipe;

screening the flow of stock in a headbox screen connected to the headbox pipe;

equalizing consistency differences in the flow of stock downstream of the headbox screen and upstream of a headbox to form an equalized and turbulent flow of stock, wherein the equalizing consistency differences is performed without dampening the flow of stock;

after the step of equalizing consistency differences, mixing an additional stock component into the equalized and turbulent flow of stock upstream of the headbox and downstream in the flow of stock from the equalizing consistency differences, and directing the equalized and turbulent flow of stock with the additional stock component through the headbox pipe and into the headbox.

8. The method of claim 7 wherein the equalizing of consistency differences is performed with a stock flow equalizer comprising a tube having an inside surface wetted by the flow of stock, wherein the inside surface has a diameter equal to an inner diameter of the headbox pipe, and the stock flow equalizer further comprises form parts arranged symmetrically around a circumference of the inside surface, wherein each of the form parts extends radially inward from the inside surface a distance in a range of 0.1 to 0.5 times an inner diameter of the headbox feed pipe.

9. The method of claim 8, wherein the form parts each include a ramp extending downstream from the inside surface to an apex having a height 0.1 to 0.5 times the inner diameter of the headbox feed pipe.

10. The method of claim 9, wherein each of the form parts has a downstream side parallel to a radial line and extending from the apex to the inside surface.

11. The method of claim 9, wherein each of the form parts has a first triangular shape in a first cross section parallel to a flow direction through the tube of the equalizer and a second triangular shape in a second cross section perpendicular to the flow direction.

12. A method comprising:

screening the flow of stock in a headbox screen;

equalizing consistency differences in the flow of stock by creating turbulence in the flow of stock downstream of the headbox screen and upstream of a headbox, wherein the turbulence forms an equalized flow of stock, wherein the equalizing consistency differences is performed without dampening the flow of stock;

mixing an additional stock component into the equalized flow of stock upstream of the headbox and after the step of equalizing consistency differences, and after the step of mixing the additional stock component, directing the equalized flow of stock with the additional stock component into the headbox.

13. The method of claim 12, wherein the step of creating turbulence is performed without adding a stock component to the stock.

14. The method of claim 12, wherein the stock flows through a headbox feed pipe from the headbox screen to the headbox, and step of equalizing consistency differences is performed in the headbox feed pipe a distance upstream of the step of mixing the additional stock component in a range of five to fifteen times a diameter of the headbox feed pipe.

15. The method of claim 12, wherein the stock flows through a headbox feed pipe from the headbox screen to the headbox, and step of equalizing consistency differences is performed in the headbox feed pipe a distance upstream of the step of mixing the additional stock component at least one diameter of the headbox feed pipe.

* * * * *